United States Patent [19]

Hayano et al.

[11] Patent Number: 4,727,231

[45] Date of Patent: Feb. 23, 1988

[54] METHOD AND APPARATUS FOR DENITRATION OF NITRATE SOLUTION BY MICROWAVE HEATING

[75] Inventors: Noriyuki Hayano, Machida; Yoshimi Kawato, Ibaraki; Tatushi Arishige, Sagamihara; Hideaki Tamai, Saitama; Shizuo Mine, Katsuta, all of Japan

[73] Assignee: Doryokuro Kakunenryo Kaihatsu Jigyodan, Tokyo, Japan

[21] Appl. No.: 910,644

[22] Filed: Sep. 23, 1986

[30] Foreign Application Priority Data

Oct. 1, 1985 [JP] Japan ..... 60-218697

[51] Int. Cl.[4] ..... H05B 6/64

[52] U.S. Cl. ..... 219/10.55 R; 219/10.55 A; 219/10.55 E; 219/10.55 F; 219/10.55 M

[58] Field of Search ..... 219/10.55 R, 10.55 A, 219/10.55 E, 10.55 M

[56] References Cited

U.S. PATENT DOCUMENTS 4,400,604 8/1983 Ohtsuka et al. ..... 219/10.55 R

*Primary Examiner*—Robert S. Macon

*Attorney, Agent, or Firm*—Wenderoth, Lind & Ponack

[57] ABSTRACT

A nitrate solution which is a substance to be treated is heated and denitrated using microwaves, by introducing the substance directly into a cylindrical oven to which microwaves are applied, horizontally rotating the oven about a vertical axis, detecting the amount of reflected waves of the applied microwaves with time to observe the heating condition of the substance, and controlling microwave power to be applied according to the detected amount of the reflected waves and the change in the amount of reflected waves with time. The cylindrical oven preferably has a construction capable of being separated into a stationary upper part and a horizontally rotatable lower part constituting a closed-bottom vessel. These two parts are combined through a choke coupling mechanism to form the oven. According to the detected values of the reflected waves, the precise control of the microwave power applied to the substance to be treated can be conducted at a suitable time.

8 Claims, 7 Drawing Figures

METHOD AND APPARATUS FOR DENITRATION OF NITRATE SOLUTION BY MICROWAVE HEATING

BACKGROUND OF THE INVENTION

1. Field of the Invention

The present invention relates to a method and apparatus for applying microwaves to a nitrate solution such as a solution of uranyl nitrate, plutonium nitrate, a mixture thereof or the like, to heat such nitrate solution, so that evaporation, concentration and denitration of the nitrate solution are conducted to produce a denitrated product.

2. Description of the Prior Art

Such a denitration technique employing the microwave heating is effectively employed, particularly in producing oxide powder for nuclear fuel pellets from the above-mentioned nitrate solution obtained in a reprocessing process of a spent nuclear fuel.

Hitherto, in conducting the evaporation, concentration and denitration of the nitrate solution by microwave heating as shown in FIG. 5, a cylindrical heating vessel 1 in which is received a substance to be treated, i.e. a nitrate solution S, is placed in an oven 2 which usually has a rectangular shape and to which microwaves are applied, and then the heating vessel 1 is horizontally rotated by means of a rotary unit 3 while heated. This is a conventional method. In the drawing, the reference numeral 4 denotes a waveguide tube and 5 denotes a gas discharging tube.

According to the application of microwaves to the solution which is the substance to be treated, such substance absorbs the microwaves so that the temperature of the substance increases. FIG. 6 is a graph showing an example of the change in temperature of the substance being treated in the case where the substance is a uranyl nitrate solution. As shown in this graph, the solution begins to boil when its temperature reaches 100 to 120 C. (at point A). Although the temperature of the solution is kept substantially constant while it is boiled and evaporated, the solution is concentrated to become a nitrate ($UO_2(NO_3)_2.H_2O$) as a result of continued evaporation thereof (at point B). The thus produced nitrate is then gradually heated over time up to 300 C. (at point C). During this heating, the nitrate eliminates its water molecules and discharges $No_x$ gases produced in decomposition of the nitrate radical, so that it is converted into an oxide ($UO_3$) which is a denitrated product. Although the temperature of the substance being treated is substantially constant while the denitration reaction proceeds, the temperature of the substance is again increased after substantial completion of the denitration reaction (at point D). A residual damp nitrate partially remaining in the heating vessel is then decomposed so that the denitration reaction further proceeds. After completion of the denitration reaction of the residual nitrate, the substance being treated is completely converted into oxide (at point E), and the temperature of the substance is further increased. The application of microwaves is stopped at this time and the denitrated product ($UO_3$) is taken out of the heating vessel.

However, as it is quite difficult to precisely measure the temperature of the substance being treated under the application of microwaves, this makes it difficult to precisely determine a completion point of the denitration reaction (at point E). As a result, there are always concerns that the application of microwaves is conducted over its limit to partially produce a superheated product ($U_3O_8$) of the oxide ($UO_3$) or that the application of microwaves is stopped at a time when the denitration of the substance being treated is not completed. When the superheated product $U_3O_8$ is produced, the temperature increases in an accelerative manner since $U_3O_8$ is larger than $UO_3$ in microwave absorption efficiency, so that adjacent $UO_3$ is converted into $U_3O_8$ one after another. When $UO_3$ is converted into $U_3O_8$, the temperature of the substance being treated increases so much that damage to the instruments occurrs and therefore, it is necessary to stop the application of the microwaves at a time when $U_3O_8$ is produced. In the case where the application of microwaves is stopped at a point between point D and point E, there remains an undenitrated portion. Namely, in the case where the application of microwaves is stopped at a time when the denitration of the substance being treated is not completed, the denitrated product can not be effectivley taken out of the heating vessel due to the presence of the residual damp nitrate.

As a method for detecting a heating condition of the substance being treated under the application of microwaves, there is a method for measuring reflected waves of the applied microwaves from the substance being treated. However, in the case where the microwave heating is conducted by using the conventional apparatus as shown in FIG. 5, the heating vessel 1 rotating in the oven 2 disturbs the microwave distribution in the oven which largely affects the reflection of the microwaves, so that, as shown in a graph in FIG. 7, a difference between the maximum value and the minimum value of the reflected waves becomes large. In addition, in the case where the oven 2 has such a large size that the length of its one side is equal to a total length of several wave-lengths of the applied microwaves, the area of the inner surface of the oven 2 is larger than the surface area of the substance S being treated (surface area of the heating vessel 1) so that the inner surface of the oven largely affects the reflected waves of the microwave to make the reflected waves of the microwave coming from the substance S ambiguous.

Although the apparatus itself for measuring the reflected waves of microwave has already been developed, it is impossible, due to the above-mentioned reasons, to precisely measure the reflected waves coming from the substance being treated even when the reflected wave measuring apparatus is employed in such a conventional denitration apparatus by microwave heating as shown in FIG. 5.

SUMMARY OF THE INVENTION

It is therefore an object of the present invention to provide a method and apparatus for denitration of nitrate solution by microwave heating, which is capable of effectively and precisely measuring the reflected waves of the applied microwaves coming from the substance being treated to make it possible to determine the heating condition of the substance and to precisely determine a time for stopping the application of the microwaves and the like.

Accordingly to the present invention, there is provided a method for denitration of a nitrate solution which is a substance to be treated, by applying microwaves to said substance to heat and denitrate the substance to produce a denitrated product, characterized by introducing the substance to be treated directly into a cylindrical oven to which microwaves are applied, horizontally rotating said oven about a vertical axis, detecting reflected waves of the applied microwaves over time to observe the heating condition of the substance, and controlling the microwave power to be applied according to the detected values of the reflected waves.

There is also provided an apparatus for effectively carrying out the above-mentioned method. The apparatus comprises an oven having a waveguide tube for microwaves and a gas discharging tube, and a microwave generator connected to the waveguide tube. In the present invention, the oven has a cylindrical shape having a construction capable of being separated into an oven upper part and an oven lower part, these upper and lower parts being coupled through a choke coupling mechanism to form the cylindrical oven, the lower part of the oven constituting a closed-bottom vessel for receiving the substance to be treated and being horizontally about a vertical axis by a rotary unit, the oven upper part of the oven being provided at a top wall thereof with the waveguide tube and the gas discharging tube. A detector for reflected waves of the applied microwaves is provided midway along the waveguide tube and the reflected wave detector is electrically connected with the microwave generator through a control unit which controls the microwave power of the microwave generator according to the detected values of the reflected wave detector.

In the present specification, the term "controlling of microwave power" means increasing or decreasing the microwave power and stopping the power application.

According to the present invention, the oven is shaped into a rotatable cylindrical form which is directly employed as a vessel for receiving the substance being treated, whereby the reflected waves of the applied microwaves are minimally affected by the inner surface of the oven. In addition, since a separate heating vessel is not placed in an oven and rotatably driven, there is no fear that the distribution of microwaves in the oven will be disturbed. Thus, it is possible to precisely detect the reflected waves of the microwaves coming from the substance being treated, whereby the microwave power can be adequately controlled according to the heating condition of the substance being treated.

PREFERRED EMBODIMENTS OF THE INVENTION

Figure 1:
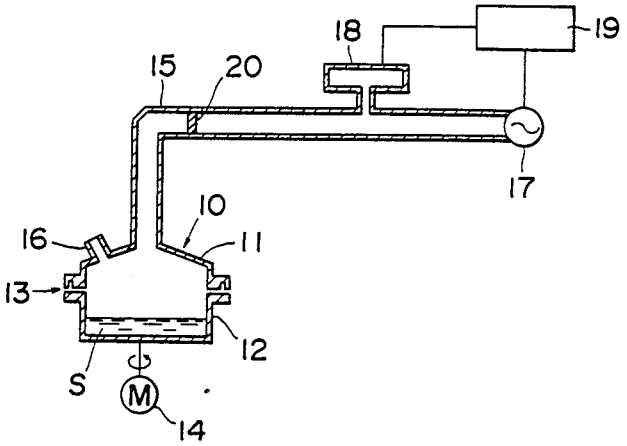
FIG. 1 is a sectional view of an embodiment of the apparatus of the present invention.

FIG. 1 illustrates an embodiment of the apparatus of the present invention. An oven 10 to which microwaves are applied has a substantially cylindrical shape as a whole and has a construction capable of being separated into an upper part 11 and a lower part 12. These two parts 11 and 12 are in a choke coupling relationship through a choke coupling mechanism 13 to form the cylindrical oven 10. The oven lower part 12 is employed as a closed-bottom vessel for receiving therein a substance S being treated. By connecting the oven lower part 12 to a rotary unit 14 such as a motor, it is possible to rotatably drive only the oven lower part 12 positioned under the choke coupling mechanism 13, while the oven upper part 11 remains stationary. On a top wall of the oven upper part 11 are mounted a waveguide tube 15 and a gas discharging tube 16. The waveguide tube 15 is connected to a microwave generator 17. The gas discharging tube 16 serves to discharge an exhaust gas to the outside of the oven. The exhaust gas is produced during the heating/denitration process of the substance being treated. The discharged gas is introduced into a condenser and a scrubber (not shown).

A reflected wave detector 18 is provided midway along the length of the waveguide tube 15. The microwaves generated from the microwave generator 17 and passed through the waveguide tube 15 are applied to the substance S being treated which is placed in the oven lower part 12. A portion of the applied microwaves is absorbed by the substance S, and the other portion of the applied microwaves is not absorbed and instead is reflected by the substance S and returned through the waveguide tube 15. The reflected waves thus returned are detected by the detector 18.

The reflected wave detector 18 is electrically connected to the microwave generator 17 through a control unit 19, which controls the microwave power of the microwave generator 17 according to electrical signals of the detected values coming from the reflected wave detector 18.

Incidentally, also provided midway along the length of the waveguide tube 15 between the oven 10 and the reflected wave detector 18, there is disposed a shielding window 20 made of a microwave transparent material.

Now, an example of the microwave heating/denitration method of the present invention will be explained hereinbelow by describing the operation of the apparatus shown in FIG. 1. The microwave generator 17 is set so as to provide a microwave power having a frequency of 2450 MHz (wavelength: 12.24 cm). The cylindrical oven 10 has a diameter equal to about 4 wavelengths and a height equal to 2 wavelengths of the microwave. Uranyl solution (acid concentration: 0.5 to 3.0N) is employed as the substance being treated, which is received in the closed-bottom vessel of the oven lower part 12. At this time, it is generally preferable, from the view point of obtaining effective denitration without any residual undenitrated portion, to charge the uranyl nitrate solution into the vessel in such an amount that an amount of uranium metal per unit bottom area of the vessel 12 is in a range of from 0.95 to 1.10 g/cm$^2$. The vessel 12 with the substance S being treated received therein is placed under the oven upper part 11, the upper part being connected to the waveguide tube 15 and being set in a stationary predetermined position so as to form part of the choke coupling mechanism 13. The applied microwaves are prevented from leaking by the choke coupling mechanism 13.

Then, the microwave generator 17 is actuated to apply microwaves to the substance S being treated within the oven 10 while the rotary unit 14 is actuated to horizontally rotate only the closed-bottom vessel of the oven lower part 12 about a vertical axis. The substance S is thus evaporated, concentrated and denitrated according to the heating condition as shown in the temperature changing pattern of FIG. 6 with the passage of time, to thereby form a denitrated product ($UO_3$).

Figure 2:
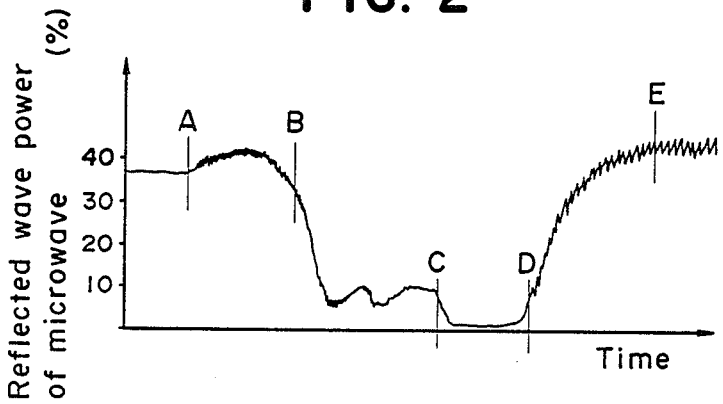
FIG. 2 is a graph showing the reflected microwave power changing pattern detected by a detector of reflected waves of microwaves when the microwaves heating/denitration treatment of one uranyl nitrate solution is carried out by using the apparatus of the present invention.
Figure 6:
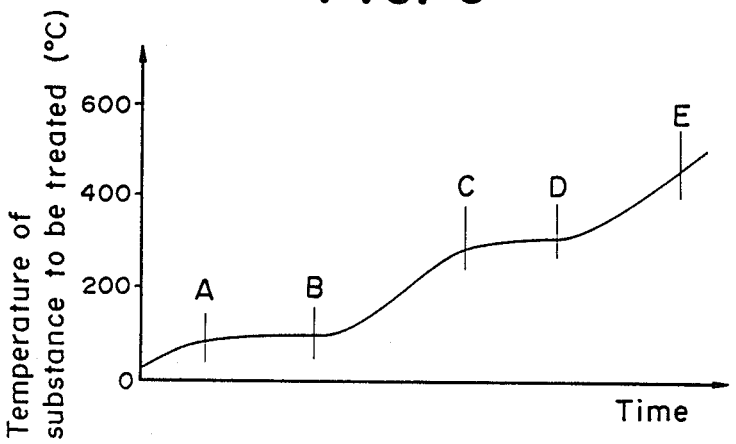
FIG. 6 is a graph showing the temperature changing pattern of the substance being treated when the uranyl nitrate solution is subjected to the microwave heating/denitration treatment.

In the present invention, the pattern of the heating condition as shown in FIG. 6 is obtained by detecting the reflected waves of the applied microwaves coming from the substance S by means of the detector 18, not by measuring the temperature changes of the substance S. A graph obtained by detecting the reflected amount of the microwaves with the passage of time by using the reflected wave detector 18 is shown in FIG. 2. Points A to E in this graph correspond to points A to E shown in the temperature changing pattern of FIG. 6, respectively. Namely, the reflected wave pattern in a period between points A and B shows a condition wherein the solution is boiled and concentrated; the reflected wave pattern in a period between points B and C shows a condition wherein water molecules are eliminated from the thus concentrated nitrate; the reflected wave pattern in a period between points C and D shows a condition wherein $NO_x$ gas is discharged while the nitrate radical is decomposed during the proceeding of denitration; and the reflected wave pattern in a period between points D and E shows a condition wherein the residual nitrate is denitrated.

In the graph of FIG. 2, the point D shows a time when the denitration reaction is substantially completed, and point E shows a time when the denitration reaction is completely finished. Consequently, immediatley after point D both the denitrated product $UO_3$ and the residual nitrate are present in the substance being treated, so that the microwave application after point D is conducted in order to denitrate the residual nitrate while at the same time preventing the denitrated product $UO_3$ from being heated as much as possible. As already described, when $UO_3$ is excessively heated, the superheated product $U_3O_8$ is produced, which superheated product is larger than $UO_3$ in microwave absorption efficiency so that a localized high-temperature area is formed and $UO_3$ adjacent to such high-temperature area is converted into $U_3O_8$. Therefore, after point D, it is sufficient to apply an amount of microwave power which is required to denitrate the residual nitrate to produce $UO_3$ without excessively increasing the temperature of $UO_3$ which has already been produced. On the other hand, at point E, since the denitration of the residual nitrate is completed, it is necessary to quickly stop the operation of the microwave generator 17 so as to not excessively heat the thus produced $UO_3$.

In the present invention, according to the reflected wave changing pattern such as the one shown in FIG. 2 obtained by the reflected wave detector 18, the rapid increase at point D of the reflected waves from near a zero level is detected and a detected signal is transmitted to the microwave generator 17 through a control unit 19 at a suitable time near point D to thereby control the microwave generator 17 so as to decrease the microwave power to a predetermined value. In addition, according to the continuous changes in the reflected wave changing pattern, it is possible to detect point E in which the increment of the reflected waves gradually decreases to zero as the pattern levels off. At the time of detecting point E, the microwave generator 17 can be stopped through the control unit 19.

Incidentally, in a period from the beginning of the microwave application to point B in which the solution is evaporated and concentrated, it is possible to control the microwave generator 17 through the control unit 19 so as to increase the applied microwave power, in order to shorten the processing time. In such a case in which the control for increasing the applied microwave power is conducted, it is possible to connect a plurality of waveguide tubes to the top wall of the oven upper part 11.

Figure 3:
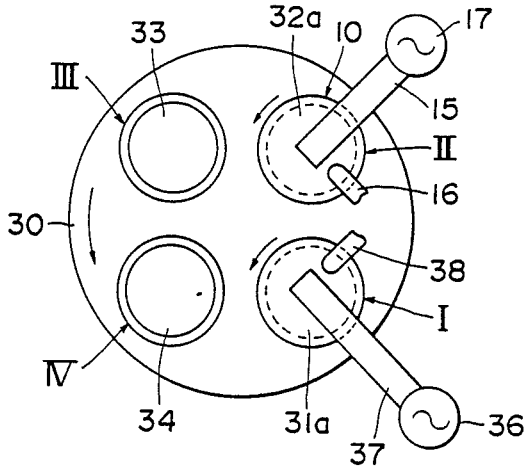
FIG. 3 is a plan view of another embodiment in which the apparatus of the present invention is adapted to a continuous heating/denitration apparatus.
Figure 4:
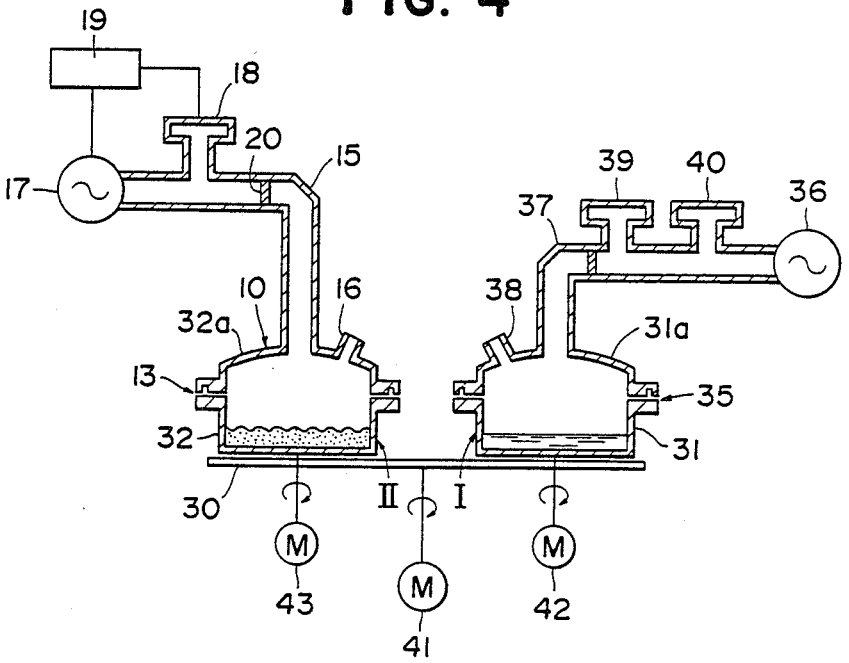
FIG. 4 is a partial longitudinal sectional view of the apparatus shown in FIG. 3.
Figure 5:
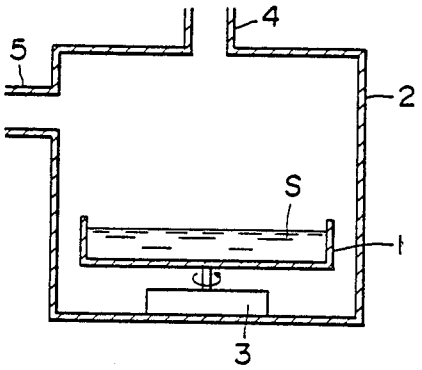
FIG. 5 (PRIOR ART)
FIG. 5 is a sectional view of a typical conventional microwave heating/denitration apparatus.
Figure 7:
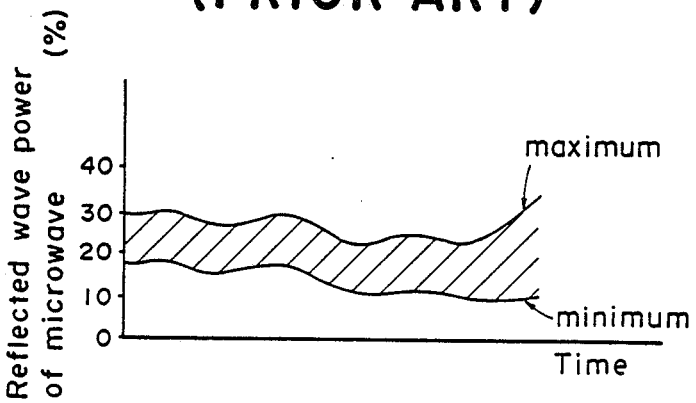
FIG. 7 (PRIOR ART)
FIG. 7 is a graph showing an example of the reflected microwave power changing pattern detected by the reflected wave detector by using the conventional apparatus shown in FIG. 5.

In FIGS. 3 and 4, there is shown another embodiment in which the apparatus of the present invention is adapted to a continuous heating/denitration apparatus. In the drawings, elements similar to those employed in the apparatus shown in FIG. 1 are denoted by the same reference numerals as employed in the apparatus shown in FIG. 1 so that the description thereof is omitted. In this continuous apparatus, four closed-bottom vessels 31, 32, 33 and 34 are placed on a turntable 30 which is intermittently rotated at predetermined intervals of time. In each of the vessels, an evaporation/concentration step I of the nitrate solution; a denitration step II of the concentrated nitrate; a cooling step III of the denitrated product; and a scraping/removing step IV of the cooled denitratd product is conducted, respectively (FIG. 3). In this embodiment, the microwave heating/denitration apparatus such as the one shown in FIG. 1 is employed as an apparatus for conducting the denitration step II. In addition, an oven section of the microwave heating apparatus for conducting the evaporation/concentration step I comprises an oven lower part 31 and an oven upper part **31*a*. The oven can be vertically separated into two parts via a choke coupling mechanism 35, similar to the oven shown in FIG. 1. On the oven upper part 31*a* are mounted a waveguide tube 37 connected to a microwave generator 36 and a gas discharging tube 38. A microwave matching device 39 and a reflected wave detector 40 are disposed midway along the length of the waveguide tube 37. The detector 40 detects the reflected waves of the applied microwaves. In FIG. 4, the reference numeral 41 denotes a motor for intermittently rotating the turntable 30 at predetermined intervals of time and 42 and 43 denote motors for continuously rotating the closed-bottom vessels 31 and 32** positioned in the evaporation/concentration step I and the denitration step II, respectively.

In operation of the continuous heating/denitration apparatus, the nitrate solution is introduced into the closed-bottom vessel 31 of the oven lower part positioned in the evaporation/concentration step I which is then placed under the oven upper part **31*a* so as to be set in a predetermined position, whereby the choke coupling mechanism 35 is formed. Then, the microwave generator 36 is actuated so that microwaves are applied to the nitrate solution in the vessel 31 through the waveguide tube 37, whereby the evaporation/concentration of the solution is conducted. During this evaporation/concentration step, the vessel 31 is horizontally rotated about or vertical axis at a speed of 1 to 9 rpm. After conducting the evaporation/concentration step for a predetermined time, the turntable 30 is rotated by the motor 41 so that only the vessel 31 under the choke coupling mechanism 35 is transferred to a position of the denitration step II so as to form the choke coupling mechanism 13 under the oven upper part 32***a*. In this position, the concentrated substance being treated in the vessel 32 (which is the vessel 31 having been transferred to the position II) is heated by microwaves issued from the microwave generator 17 and is subjected to the denitration operation, so that the substance being treated is converted into oxide powder which is a denitrated product. During this period, the vessel 32 is horizontally rotated about a vertical axis at a speed of 1 to 9 rpm. Since the microwave heating/denitration apparatus of the present invention is employed in this denitration step II, according to the reflected wave changing pattern as shown in FIG. 2 obtained by the reflected wave detector 18, it is possible to precisely determine both point D at which the denitration reaction is substantially completed and point E at which the denitration reaction is completely finished. By such a precise determination of points D and E, it is possible to decrease the microwave power issued from the microwave generator 17 by means of the control unit 19 and to stop the microwave generator 17 at the most appropriate time.

After conducting the denitration treatment for a predetermined time in the above-described manner, the turntable 30 is again rotated by the motor 41 so that only the vessel 32 under the choke coupling mechanism 13 is transferred to a position in the cooling step III. During a stationary period in this position, the denitrated product in the vessel 33 (which is the vessel 32 having been transferred to the position III) is cooled. After conducting the cooling step III for a predetermined time, the turntable 30 is again rotated by the motor 41 so that the vessel 33 is transferred to a position in the scraping/removing step IV. In this position, the denitrated product having been cooled in the vessel 34 (which is the vessel 33 having been transferred to the position IV) is scraped by a scraping unit (not shown) and removed from the vessel 33. As is apparent from the description, hereinabove, both the vessels 33 and 34 placed in the positions of the cooling step III and the scraping/removing step IV respectively are not covered by their own upper parts, so that only the closed-bottom vessels are shown in the positions III and IV in FIG. 3.

In the explanation described above, the sequential treatment steps of the substance being treated is explained with respect to one closed-bottom vessel. In fact, however, after the evaporation/concentration step I has been completed within one vessel and this vessel has been transferred to the position of the denitration step II, another new vessel having the nitrate solution received therein is sequentially placed in the empty position of the evaporation/concentration step I. Thus, it is possible to continuously carry out a series of the treatments of the evaporation/concentration step, the denitration step, the cooling step, the scraping/removing step as the turntable 30 is rotated.

In the illustrated embodiment of the continuous apparatus, one vessel is employed for each of the four steps. However, it is also possible to conduct both the evaporation/concentration step and the denitration step by using one vessel, or, in order to shorten the treatment time of the respective steps, it is also possible to conduct each of the evaporation/concentration step I and the denitration step II by using a plurality of vessels.

As explained in the foregoing, according to the present invention, the reflected waves of microwaves coming from the substance being treated can be detected with minimum influence by the wall surface of the oven, and the heating condition of the substance being treated can be precisely determined from the thus detected values. Consequently, according to the detected values of the reflected waves obtained by the reflected wave detector, it is possible to precisely control the microwave power applied to the substance being treated at a suitable time. As a result, a good denitrated product can be obtained in a stable manner without producing any of the undenitrated portion and the superheated product.

Although the present invention has been described with reference to the preferred embodiments thereof, many modifications and alterations may be made with the scope of the appended claims.

What is claimed is:

1. A method for denitration of a nitrate solution which is a substance to be treated, by applying microwaves to said substance to heat and denitrate the substance to produce a denitrated product, comprising:

introducing the substance to be treated directly into a cylindrical oven to which microwaves are applied, horizontally rotating said oven, detecting an amount of reflected waves of the applied microwaves with time to observe a heating condition of the substance, and controlling microwave power of the applied microwaves according to the detected amount of the reflected waves.

2. A method according to claim 1, wherein a point of the heating condition at which the denitration reaction is substantially completed is determined by detecting the amount of the reflected waves and a change in the amount of reflected waves with time, and the microwave power which is applied to the substance is decreased to a predetermined value at a predetermined time near said point.

3. A method according to claim 1, wherein a point of the heating condition at which the denitration reaction is completely finished is determined by detecting the amount of the reflected waves and a change in the amount of reflected waves with time, and the application of the microwave power is quickly stopped at the time of detecting said point.

4. In an apparatus for denitration of a nitrate solution which is a substance to be treated, including an oven having a microwave waveguide tube and a gas discharging tube, and a microwave generator connected to the waveguide tube, the improvement comprising:

the oven being cylindrical in shape and having a construction capable of being separated into an oven upper part and an oven lower power, the upper and lower parts being coupled through a choke coupling mechanism to form the cylindrical oven, the oven lower part constituting a closed-bottom vessel for receiving therein the substance to be treated by microwaves applied from the microwave generator, the lower part being horizontally rotatable by a rotary unit, the oven upper part being provided at a top wall thereof with the waveguide tube and the gas discharging tube, a detector for detecting the amount of reflected waves of applied microwaves being provided along the waveguide tube and the reflected wave detector being electrically connected with the microwave generator through a control unit which controls microwave power of the microwave generator according to the amount of reflected waves detected by the reflected wave detector.

5. An apparatus according to claim 4, wherein a plurality of waveguide tubes are provided at the top wall of the oven upper part.

6. An apparatus according to claim 4, wherein a shielding window made of microwave transparent material is disposed in the waveguide tube between the oven and the reflected wave detector.

7. An apparatus according to claim 4, wherein the cylindrical oven has a diameter equal to about 4 wavelengths and a height equal to about 2 wavelengths of the applied microwaves, when a microwave frequency of 245 $OMH_z$ is employed.

8. A method according to claim 1, wherein the substance is introduced into a closed-bottom vessel forming a lower part of the oven followed by placing the lower part of the oven under an upper part of the oven, the oven including a choke coupling mechanism between the upper and lower parts preventing the applied microwaves from leaking out of the oven, the upper part of the oven being connected to a microwave generator and a reflected wave detector and the lower part of the oven being connected to means for rotating the lower part of the oven about a vertical axis.

* * * * *

UNITED STATES PATENT AND TRADEMARK OFFICE

CERTIFICATE OF CORRECTION

PATENT NO. : 4,727,231

DATED : 02/23/88

INVENTOR(S) : Noriyuki HAYANO et al.

It is certified that error appears in the above-identified patent and that said Letters Patent is hereby corrected as shown below:

Title page:

Line 73, after "Doryokuro Kakunenryo Kaihatsu Jigyodan, Tokyo, Japan", please insert -- New Japan Radio Co., Ltd., Tokyo, Japan--.

Signed and Sealed this

Fourth Day of April, 1989

*Attest:*

*Attesting Officer*

DONALD J. QUIGG

*Commissioner of Patents and Trademarks*